US005351023A

United States Patent [19]

Niiranen

[11] Patent Number: 5,351,023

[45] Date of Patent: Sep. 27, 1994

[54] HELIX RESONATOR

[75] Inventor: Erkki O. Niiranen, Saukonkuja, Finland

[73] Assignee: LK-Products OY, Kempele, Finland

[21] Appl. No.: 50,917

[22] Filed: Apr. 21, 1993

[30] Foreign Application Priority Data

Apr. 21, 1992 [FI] Finland ..... 921762

[51] Int. Cl.[5] ..... H01P 1/20; H01P 7/00

[52] U.S. Cl. ..... 333/202; 333/219; 333/235

[58] Field of Search ..... 333/202, 205, 206, 207, 333/219, 235; 336/199, 200

[56] References Cited

U.S. PATENT DOCUMENTS

| | | | |
|---|---|---|---|
| 3,247,475 | 4/1966 | Buetow | 333/235 |
| 4,342,969 | 8/1982 | Myers et al. | 333/33 |
| 4,459,571 | 7/1984 | Fraser | 333/202 |
| 4,682,131 | 7/1987 | May | 333/219 X |
| 4,977,383 | 12/1990 | Niiranen | 333/219 |
| 5,047,739 | 9/1991 | Kuokkanen | 333/219 |

FOREIGN PATENT DOCUMENTS

| | | |
|---|---|---|
| 59-133705 | 11/1984 | Japan . |
| 2199904 | 8/1990 | Japan . |
| 3208401 | 9/1991 | Japan . |
| 2224888A | 5/1990 | United Kingdom . |

*Primary Examiner*—Seungsook Ham
*Attorney, Agent, or Firm*—Darby & Darby

[57] ABSTRACT

A helix resonator comprises a printed board (1) made of dielectric material, a resonator coil (2) having a high impedance end and a low impedance end and mounted on the printed board and formed by a conductor wound several turns to form a cylindrical coil, an electrically conducting cover (6) surrounding the resonator coil (2), and on the surface of the printed board a strip line (4) of electrically conducting material electrically coupled to the last or second last turn of the resonator coil (2) near the high impedance end.

14 Claims, 1 Drawing Sheet

HELIX RESONATOR

BACKGROUND OF THE INVENTION

The invention relates to a helix resonator. In particular, it relates to a helix resonator comprising a helically wound electrical conductor having a low impedance end and a high impedance end, and a reactive element.

A helix resonator or helix is a transmission line resonator having an electrical length of about a quarter-wave length. It is well known to use helix resonators as tuning elements, and they are widely used in filters in the high frequency range, particularly from 100 to 2000 MHz. Resonators of this kind comprise inductive elements such as an electrical conductor wound into a cylindrical or helical coil, and a metallic cover surrounding the cylindrical coil and spaced a distance away from it. The low impedance end of the coil is earthed and may be connected directly to the metallic cover which is itself earthed.

A possible arrangement for connecting the helical coil to the metallic cover is to have a straight length of conductor at an end of the helical coil and arranged approximately perpendicular to an end face of the resonator cover. The first turn of the helical coil is spaced a distance from the cover determined by the straight length of conductor. The other end of the helical coil is the high impedance end which is spaced away from and capacitively coupled to the cover.

The resonator is electrically connected to the rest of a filter circuit, another electronic circuit or the like by coupling a connecting conductor to the helical coil. From the helical coil the connecting conductor passes through, and is insulated from the cover and is then connected to a circuit. Coupling of the connecting conductor to the resonator may be by means of a solder joint or the like, and the point at which the coupling is made is known as the tapping point. The input impedance to the coil seen by the connecting conductor at the tapping point depends upon its position along the helical coil. By an appropriate choice of tapping point the resonator can be matched to the circuit. The tapping point may be determined experimentally or by theoretical calculations. However, it is generally located at or near the first turn of the helical coil.

The characteristic impedance of the helix resonator is determined by the ratio of the coil diameter and the inner dimension of the cover surrounding it, by the mutual distance between the coil turns or the so called pitch, and by the dielectric material supporting the resonator. The resonance frequency of the helix resonator is a function of the coil's physical dimensions, the capacitive construction and the distance between the high impedance end and the cover. Therefore production of a resonator with a certain frequency range requires exact and accurate construction.

From Finnish patent FI-78198 a helix resonator is disclosed, in which the resonator coil is supported by a dielectric board. A portion of the dielectric board contains an electric circuit formed by strip lines to which the resonator is electrically connected. Means to produce a helix resonator with an exact and reproducible tapping point is disclosed in Finnish patent FI-80542. In FI-80542 there is disclosed a construction which is partly the same as in the resonator of patent FI-78198, but at a certain place on the surface of the dielectric board there is a micro strip conductor, whereby the coil is always connected at the same place to the micro strip when the coil is connected to the microstrip. The micro strip conductor can also be guided directly outside the resonator or it can be connected to the electrical circuit on the dielectric board, which acts as a support as disclosed in Finnish patent FI-78198.

Helix resonators are used in high frequency radio equipment due to their good high frequency characteristics, and especially due to their small size. When several of these resonators are placed close together and connected in a suitable way to a form a working unit it is possible to manufacture a small size high frequency filter with good high frequency characteristics. These filters are widely used in radio equipment, particularly in mobile radio telephones and in radio telephone equipment mounted in cars. As the size of radio equipment decreases, the filter size is also substantially reduced. This requires greater accuracy than previously in the manufacture and assembly of high frequency components, due to a corresponding reduction in tolerances.

The physical lengths of helix resonators used in high frequency filters often differ considerably from each other. In a single filter it is possible that all the resonators have different lengths, which increases the number of different components required to assemble the filter. The increase in the component number can substantially increase the product's manufacturing time, or at least the risk of mix-up between components. A large number of different components impedes the development of automatization and can hinder increased automatization degree in the filter production.

SUMMARY OF THE INVENTION

The foregoing problems and disadvantages are addressed by the following invention, which provides a helix resonator comprising a helically wound electrical conductor having a low impedance end and a high impedance end, and reactive means characterised in that the reactive means comprise a predetermined length of electrically conductive material coupled at or adjacent to the high impedance end of the helically wound conductor.

The advantage of the present invention is that there is provided a resonator structure which enables resonator coils of physically different dimension or helix resonators of different dimensions to be replaced by resonators having resonator coils of equal length.

The predetermined length of electrically conductive material may comprises a strip line disposed on an electrically insulating substrate. A particularly convenient way of providing the length of electrically conductive material is to print it in the substrate. This has the advantage that it aids mass production and is an accurate way of forming the predetermined length of electrically conductive material. The helically wound electrical conductor may be supported by the insulating substrate which obviates the need for other supporting structures for the helically wound electrical conductor.

Preferably the helically wound electrical conductor is wound around the electrically insulating substrate which has the advantage that the helically wound electrical conductor and substrate form a compact unit.

A portion of the helically wound electrical conductor may be deformed from the helical shape for coupling to the stripline. Such deformation provides a simple and straight forward method of coupling the helically wound electrical conductor to the stripline.

Advantageously the electrically insulating substrate comprises a protruding section of a circuit board. Thus there is no need for a separate insulating substrate to be provided for supporting the helically wound electrical conductor or the predetermined length of electrically conductive material. Furthermore, the helix resonator can be easily formed on a circuit board by such an arrangement.

The stripline may be configured such that it extends either parallel and/or transversely to the longitudinal direction of the protruding section of circuit board. This has the advantage that the area of the protruding section can be utilised effectively.

The stripline may comprises a coupling pad by which coupling to the helically wound electrical conductor is facilitated.

Advantageously, the strip line may have measurement lines disposed along it and extending transversely therefrom, which assists fine tuning of the helix resonator once it has been assembled.

In particular, one or more helix resonators may be utilised in an r.f. filter, and in the case of more than one helix resonator the helix resonators may have different resonant frequencies from each other yet comprise helically wound electrical conductors which are substantially identical. This has the advantage that only one size or type of helically wound electrical conductor need to be used to construct a filter having helix resonators of different resonant frequencies.

Suitably a radio may comprise a helix resonator as disclosed above, which has the advantage that the radio can be made more compact and small.

DESCRIPTION OF A PREFERRED EMBODIMENT

A specific embodiment of the invention will now be described, by way of example, and with reference to the accompanying drawings.

Figure 1:
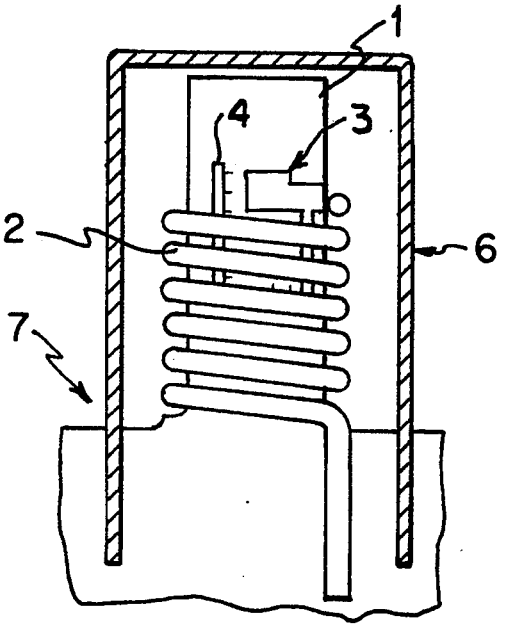
FIG. 1 shows a sectional view of a helix resonator according to the invention.

FIG. 1 shows a sectional view of the helix resonator according to the invention in order to clarify its essential characteristics. At the edge of the printed board 1 made of dielectric material, of which only a part is shown here, there is formed a projection or branch, around which a resonator coil 2 is mounted so that the projection is within the coil and supporting it.

The resonator coil 2 is formed by a conductor wound into a cylindrical coil comprising several turns. The width of the printed board 1 projection is preferably equal to the inner diameter of the coil 2 and its length is at least equal to the height of the coil 2, whereby the coil 2 is firmly held in place. The upper end of the resonator coil 2 is connected via the connecting point 3 to a strip line 4 formed on the printed board 1. The connecting point 3 preferably extends to the edge of the printed board 1.

The connection between the resonator coil 2 and the connecting point 3 can be made by any method suited to the respective situation, e.g. by soldering or electrically conductive adhesive cement. Of course the resonator coil 2 may be connected to the strip line by an electrical connection in some other way, e.g. through a jumper wire or by bending a part of a turn of the resonator coil 2 so that this part contacts the strip line 4. Thus the connecting point 3 is not essential to the invention, but it is preferred that the strip line 4 on the printed board 1 is connected electrically to the upper end of the resonator coil 2, preferably to the last or the second last turn of the resonator coil 2 at its high impedance end. This is because the strip line 4 should be connected to the top of the resonator coil 2 in order to lengthen the resonator coil 2.

In this invention the strip line 4 is thus an extension of the resonator coil 2, and is used to decrease the resonance frequency of the resonator, this extension not being used to electrically connect the resonator to the filter circuit as in tapping. The length of the strip line 4 depends on the desired resonance frequency. Thus a number of filters 7 having different resonance frequencies and comprising a single resonator coil 2 can be made using resonator coils 2 having the same dimensions.

Figure 2:
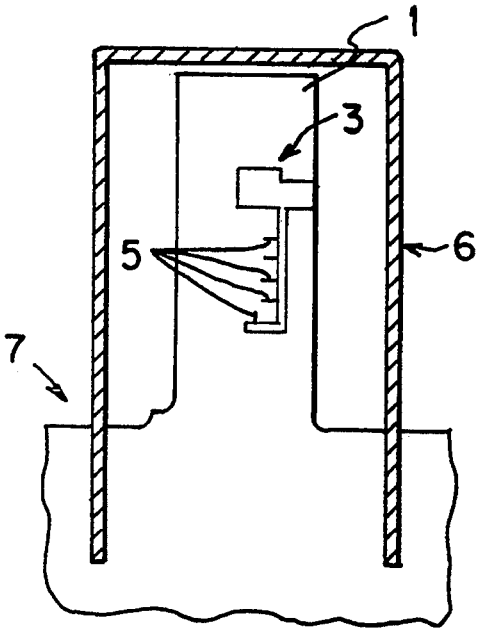
FIG. 2 shows the construction of the strip line according to the invention.
Figure 3:
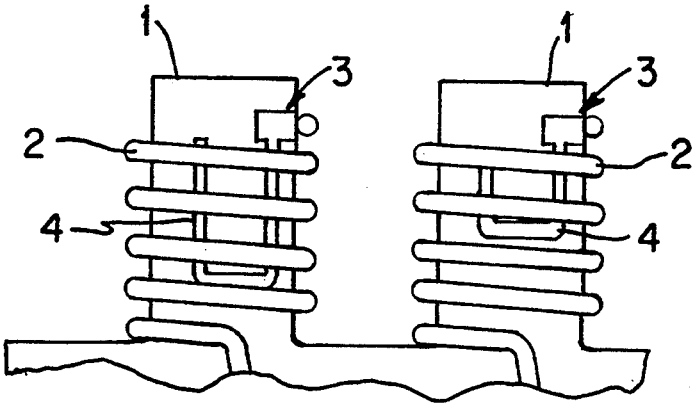
FIG. 3 shows a sectional view of a multi-coil filter using helix resonators according to the invention.

Alternatively, all resonator coils 2 of a multi-coil filter as shown in FIG. 3 can be made with equal dimensions by dimensioning the length of the strip line 4 suitably so that the length and width of the strip line 4 is selected in order to obtain the desired resonance frequency of each resonator. The strip line 4 can extend in parallel, diagonally or transversely to the longitudinal direction of the projection of the printed board 1. Thus it can have any direction, and it may extend towards the lower end of the resonator coil 2 or towards the lower impedance end, and/or above the resonator coil 2 or above the high impedance end, as is shown in the figure. One end of the strip line 4 is not connected anywhere, but it forms the high impedance end of the transmission line, which is formed by the resonator coil 2 and the strip line 4. In order to more easily indicate the length of the strip line 4 it is possible to add suitable measurement lines 5 transversely to the longitudinal direction of the strip line 4, and to suitably select the mutual distance between the lines. This is shown in more detail in FIG. 2. At a distance from the resonator coil 2 and around it there is mounted a cover 6 of electrically conducting material, such as metal, which is fastened at its other end to the printed board 1. As shown in FIGS. 1 and 2, the strip line 4 is disposed on a printed board and is connected to the printed board at a connection point arranged in a region along the conductor within two conductor turns from the terminating end. The strip line has such a form and extends in such a direction in relation to the helically wound electrical conductor that at least part of the strip line is situated on the printed board in a region between the terminating end and the low impedance end.

The construction according to the present invention makes it possible to change the resonance frequencies of the resonators by changing the dimensions of the strip line on the printed board, keeping the resonator coil unchanged. Then particularly in filters of the band-pass type, it is possible to avoid changes in the coupling holes between the resonance circuits, the making of the holes being a time consuming phase which increases costs. For example, in a filter with 8 helix resonators having resonator coils with lengths between 6 turns 260° and 7 turns 8°, these coils may be replaced by resonators according to the invention, each having a resonator coil with a physical length of 6 turns 260°. Thus, instead of eight resonator coils with different dimensions we now need only eight resonator coils with equal physical dimensions, the different resonance frequencies of which we according to the invention obtain by varying the dimensions of the strip lines.

The scope of the foregoing disclosure includes any novel feature or novel combination of features disclosed therein either explicitly or implicitly or any generalisation thereof irrespective of whether or not it relates to the claimed invention or mitigates any or all of the technical problems addressed by the present invention. The applicant hereby gives notice that new claims may be formulated to such features during the prosecution of the present application or any such further application derived therefrom.

What we claims is:

1. A helix resonator comprising:

a printed board of electrically insulating material, a helically wound electrical conductor having a low impedance end and a high impedance end, said high impedance end ending in a terminating end of the conductor, said helically wound electrical conductor being wound around said printed board and being connected to said printed board at a connection point arranged in a region along the conductor within two conductor turns from said terminating end, and reactive means comprised of a strip line of predetermined length disposed on said printed board of electrically insulating material, wherein said strip line is coupled to said helically wound electrical conductor at said connection point, and said strip line has such a form and extends in such a direction in relation to the helically wound electrical conductor that at least part of the strip line is situated on said printed board in a region between said terminating end and said low impedance end of the helically wound electrical conductor, said at least part of the strip line extending toward the low impedance end so that the helically wound electrical conductor also is wound around the at least one part of the strip line.

2. A helix resonator according to claim 1, wherein said printed board of electrically insulating material comprises a protruding section around which said electrical conductor is wound and on which said strip line is disposed.

3. A helix resonator according to claim 2, wherein said strip line extends in a direction parallel to a longitudinal axis of said protruding section.

4. A helix resonator according to claim 2, wherein said strip line extends transversely to a longitudinal direction of said protruding section.

5. A helix resonator according to claim 1, wherein the strip line comprises a coupling pad by which the helically wound electrical conductor is coupled to the strip line.

6. A helix resonator according to claim 1, wherein part of said strip line extends beyond the high impedance end of the helically wound electrical conductor.

7. A helix resonator according to claim 1, wherein the strip line has measurement lines disposed along the strip line and extending transversely therefrom.

8. A helix resonator according to claim 1, wherein the helically wound electrical conductor is supported by the printed board of electrically insulating material.

9. A helix resonator filter having at least one helix resonator comprising:

a printed board of electrically insulating material, a helically wound electrical conductor having a low impedance end and a high impedance end, said high impedance end ending in a terminating end of the conductor, said helically wound electrical conductor being wound around said printed board and being connected to said printed board at a connection point arranged in a region along the conductor within two conductor turns from said terminating end, and reactive means comprised of a strip line of predetermined length disposed on said printed board of electrically insulating material, wherein said strip line is coupled to said helically wound electrical conductor at said connection point, and said strip line has such a form and extends in such a direction in relation to the helically wound electrical conductor that at least part of the strip line is situated on said printed board in a region between said terminating end and said low impedance end of the helically wound electrical conductor, said at least part of the strip line extending toward the low impedance end so that the helically wound electrical conductor also is wound around the at least one part of the strip line.

10. A helix resonator filter according to claim 9, wherein the filter comprises at least two helix resonators.

11. A helix resonator filter according to claim 10, wherein a resonator frequency of at least one helix resonator is different from a resonant frequency of another helix resonator.

12. A helix resonator filter according to claim 10, wherein each helix resonator has a helically wound electrical conductor which is substantially identical to each other.

13. A circuit board having a circuit adapted to be coupled to a helix resonator comprising:

a printed board of electrically insulating material, a helically wound electrical conductor having a low impedance end and a high impedance end, said high impedance end ending in a terminating end of the conductor, said helically wound electrical conductor being wound around said printed board and being connected to said printed board at a connection point arranged in a region along the conductor within two conductor turns from said terminating end, and reactive means comprised of a strip line of predetermined length disposed on said printed board of electrically insulating material, wherein said strip line is coupled to said helically wound electrical conductor at said connection point, and said strip line has such a form and extends in such a direction in relation to the helically wound electrical conductor that at least part of the strip line is situated on said printed board in a region between said terminating end and said low impedance end of the helically wound electrical conductor, said at least part of the strip line extending toward the low impedance end so that the helically wound electrical conductor also is wound around the at least one part of the strip line.

14. A radio telephone having a helix resonator comprising:

a printed board of electrically insulating material, a helically wound electrical conductor having a low impedance end and a high impedance end, said high impedance end ending in a terminating end of the conductor, said helically wound electrical conductor being wound around said printed board and being connected to said printed board at a connection point arranged in a region along the conductor within two conductor turns from said terminating end, and reactive means comprised of a strip line of predetermined length disposed on said printed board of electrically insulating material, wherein said strip line is coupled to said helically wound electrical conductor at said connection point, and said strip line has such a form and extends in such a direction in relation to the helically wound electrical conductor that at least part of the strip line is situated on said printed board in a region between said terminating end and said low impedance end of the helically wound electrical conductor, said at least part of the strip line extending toward the low impedance end so that the helically wound electrical conductor also is wound around the at least one part of the strip line.

* * * * *